US005197743A

United States Patent [19]

Hanson, Jr.

[11] Patent Number: 5,197,743

[45] Date of Patent: Mar. 30, 1993

[54] GOLFING DART GAME APPARATUS

[76] Inventor: Howard J. Hanson, Jr., Box 3425, Lacombe, Alberta, Canada, T0C 1S0

[21] Appl. No.: 808,473

[22] Filed: Dec. 16, 1991

[51] Int. Cl.[5] ..... F41J 3/00

[52] U.S. Cl. ..... 273/378; 273/389; 273/408; 273/409; 273/418

[58] Field of Search ..... 273/378, 383, 389, 408, 273/409, 418

[56] References Cited

U.S. PATENT DOCUMENTS

| | | | |
|---|---|---|---|
| 1,175,692 | 3/1916 | Boicourt | 273/378 |
| 1,928,768 | 10/1933 | Sell et al. | 273/409 |
| 3,697,073 | 10/1972 | Dooley | 273/408 X |
| 3,853,318 | 12/1974 | Cagan | 273/379 |
| 3,979,117 | 9/1976 | Worsham | 273/408 |
| 5,020,807 | 6/1991 | Barkley | 273/409 |

FOREIGN PATENT DOCUMENTS

| | | | |
|---|---|---|---|
| 364932 | 1/1932 | United Kingdom | 273/408 |
| 2116053 | 9/1983 | United Kingdom | 273/408 |

*Primary Examiner*—William H. Grieb
*Attorney, Agent, or Firm*—Leon Gilden

[57] ABSTRACT

A dart game includes a board with a simulation golf course presented thereon, including fairways, greens, sand traps, and the like. An object in play of the game requires progression from a fairway to a green to a scoring. Associated water and sand traps are in operative association to provide visual indication of penalty shots and the like.

3 Claims, 4 Drawing Sheets

GOLFING DART GAME APPARATUS

BACKGROUND OF THE INVENTION

1. Field of the Invention

The field of invention relates to game apparatus, and more particularly pertains to a new and improved golfing dart game apparatus wherein the same is arranged for the simulation of a golfing game utilizing a dart game environment.

2. Description of the Prior Art

Dart games of various types have been presented in the prior art for simulation of game structure such as set forth in U.S. Pat. No. 3,979,117 to Worsham wherein a football game is simulated in a dart game organization.

U.S. Pat. No. 3,853,318 to Cagan sets forth a dart game simulating a pinball apparatus.

U.S. Pat. No. 3,697,073 to Dooley sets forth a golf photography board simulating a golfing scenario.

As such, it may be appreciated that there continues to be a need for a new and improved golfing dart game apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of dart game apparatus now present in the prior art, the present invention provides a golfing dart game apparatus wherein the same is arranged for simulation of a golfing game utilizing a dart board apparatus. As such, the general purpose of the present invention, which will be described subsequently in greater detail, is to provide a new and improved golfing dart game apparatus which has all the advantages of the prior art dart game apparatus and none of the disadvantages.

To attain this, the present invention provides a dart including a board with a simulation golf course presented thereon, including fairways, greens, sand traps, and the like. An object in play of the game requires progression from a fairway to a green to a scoring. Associated water and sand traps are in operative association to provide visual indication of penalty and the like.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golfing dart game apparatus which has all the advantages of the prior art dart game apparatus and none of the disadvantages.

It is another object of the present invention to provide a new and improved golfing dart game apparatus which may be easily and efficiently manufactured and marketed.

It is a further object of the present invention to provide a new and improved golfing dart game apparatus which is of a durable and reliable construction.

An even further object of the present invention is to provide a new and improved golfing dart game apparatus which is susceptible of a low cost of manufacture with regard to both materials and labor, and which accordingly is then susceptible of low prices of sale to the consuming public, thereby making such golfing dart game apparatus economically available to the buying public.

Still yet another object of the present invention is to provide a new and improved golfing dart game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
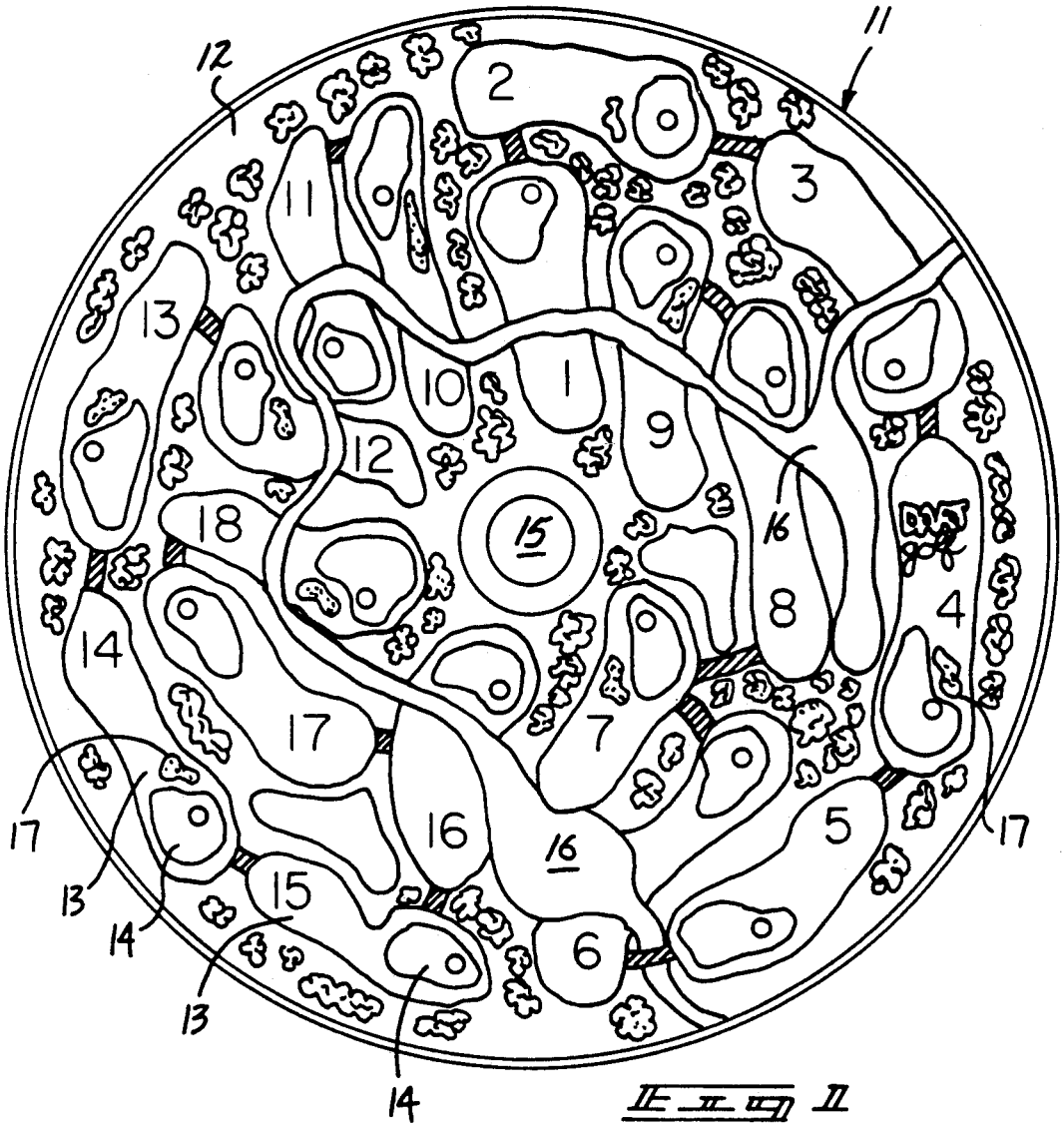
FIG. 1 is an orthographic frontal view of the dart board structure.
Figure 2:
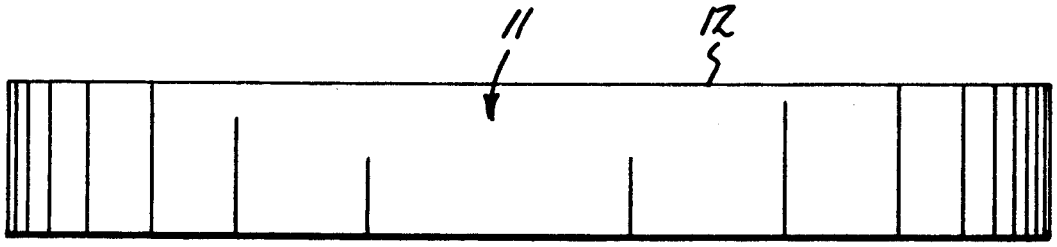
FIG. 2 is an orthographic end view of the dart board structure.

With reference now to the drawings, and in particular to FIGS. 1 to 9 thereof, a new and improved golfing dart game apparatus embodying the principles and concepts of the present invention and generally designated by the reference numeral 10 will be described.

Figure 3:
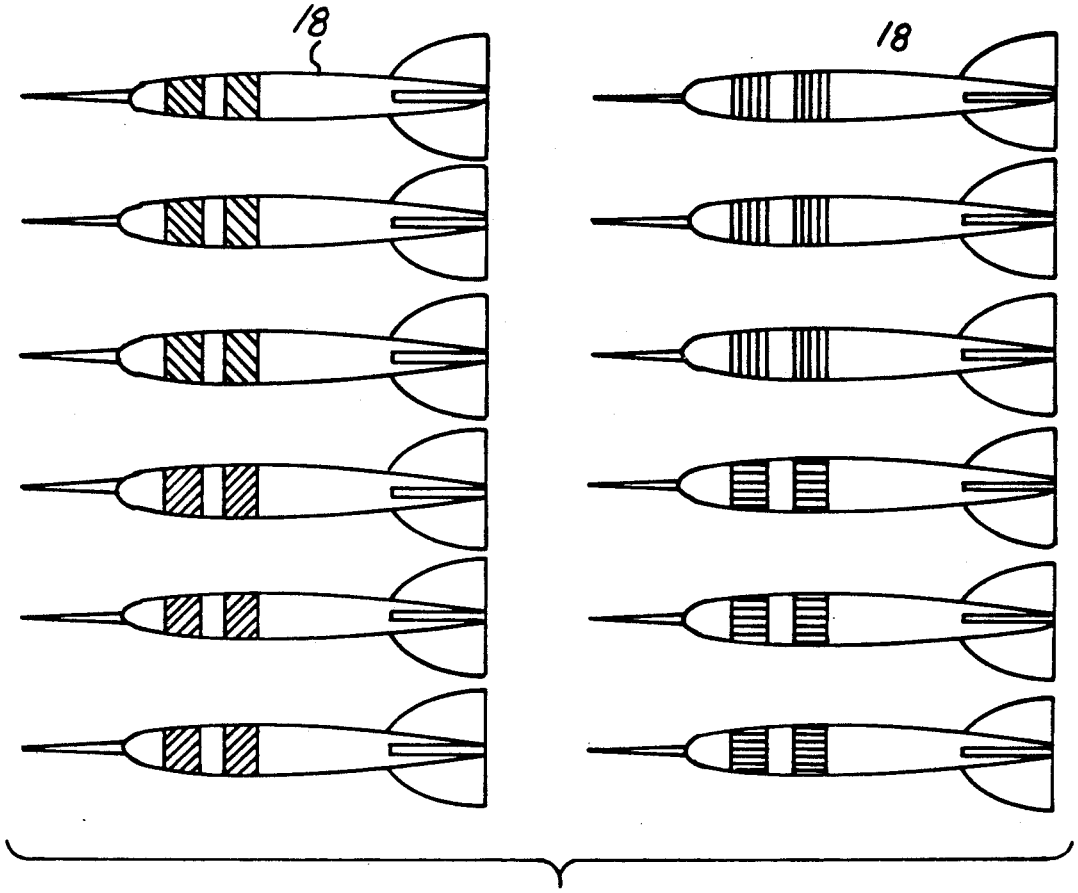
FIG. 3 is an orthographic view of dart members utilized by the invention.

More specifically, the golfing dart game apparatus 10 of the instant invention essentially comprises a game board 11, including a polymeric covering coextensive with a top wall 12 of the game board. The game board is demarcated into a plurality of fairways 13, typically enumerated from the digits 1-18 for correspondence to a typical golf course. Each of the target fairways includes target greens 14, with a central bull's-eye 15 positioned medially and coaxially of the game board 11. The game board further includes a water hazard surface area 16 and a plurality of sand trap area portions 17 to simulate a golf course scenario. A multiplicity of dart projectiles 18, such as illustrated in FIG. 3, are utilized in association with the game board structure.

Typical play of the game provides for at least three darts to be afforded each player, with initial hit on a target fairway 13 as one stroke to a total score, with a dart projectile 18 striking any other target effects a two stroke addition. A second dart thrown is directed to a target green 14 with one stroke added, wherein if a target dart 18 strikes the green or an associated circle on the green to typify a target cup, one stroke is added and the player proceeds to the next enumerated fairway. If a dart lands at any other position upon the game board 11, two strokes are added. With a third dart, the object is to strike the central bull's-eye 15, wherein if a strike is thusly accomplished, one stroke is added. An outer ring is provided to the central bull's-eye, wherein if that is struck, two strokes are added, if a strike anywhere else effects a three stroke addition to a score. As in golf, a player with the least number of strokes is declared a winner.

Figure 4:
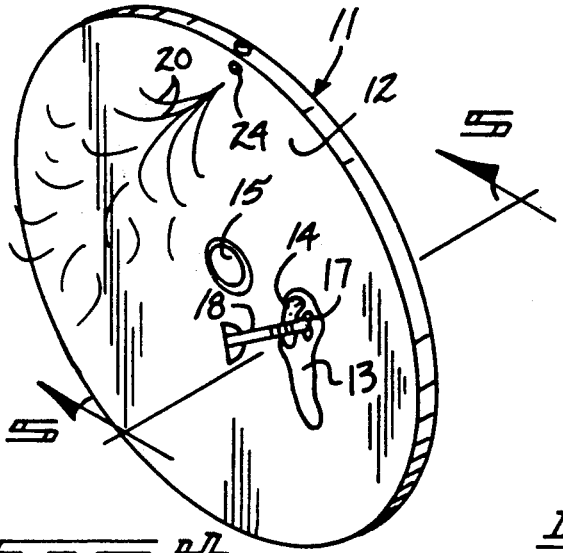
FIG. 4 is an isometric illustration of the dart board illustrating its operative association with a sand trap.
Figure 5:
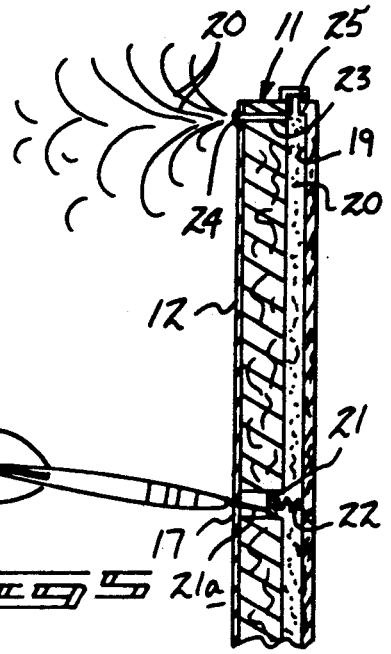
FIG. 5 is an orthographic view, taken along the lines 5—5 of FIG. 4 in the direction indicated by the arrows.

The FIGS. 4 and 5 illustrate the use of a power chamber 19 contained within the game board 11 rearwardly of the top wall 12 in communication with a powder chamber piston 21 slidably received within a powder cavity 21*a* in communication with the top wall 12. Striking of a sand trap area portion 17 directs the dart 18, as illustrated in FIG. 5, to impact the piston 21 and direct the piston 21 compressing an associated spring 22 and effect compression of the powder such as talcum powder contained within the powder chamber 19 to be directed through an associated powder chamber exit conduit 23 and through the powder chamber exit port 24 directed through the top wall 12. This provides visual impact of striking of a sand trap area 17 to effect an associated penalty in scoring of the game by additional strokes of an arbitrary number to be decided by associated players.

Figure 6:
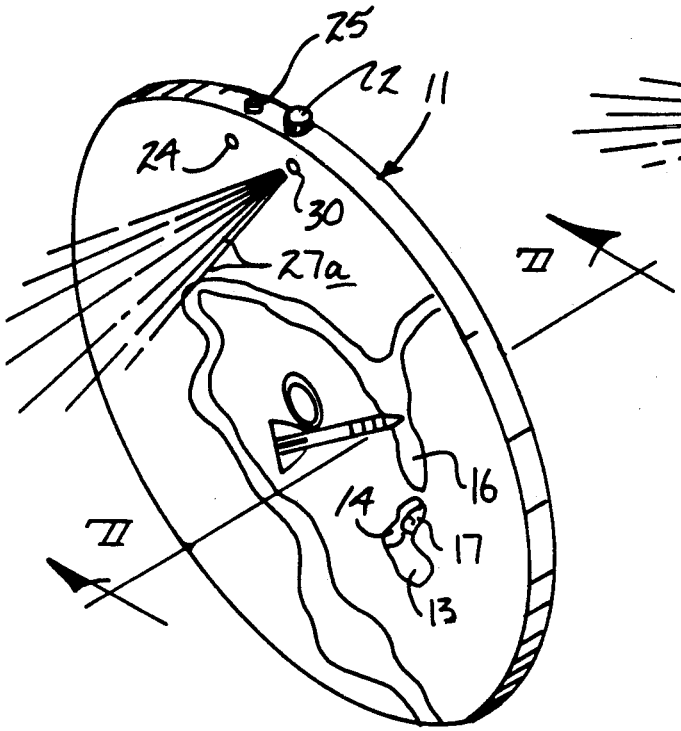
FIG. 6 is an isometric illustration of the dart board in association with a water hazard.
Figure 7:
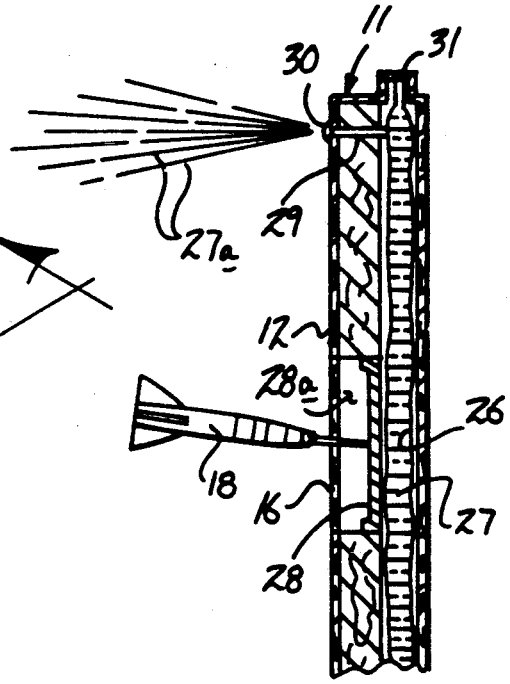
FIG. 7 is an orthographic view, taken along the lines 7—7 of FIG. 6 in the direction indicated by the arrows.
Figure 8B:
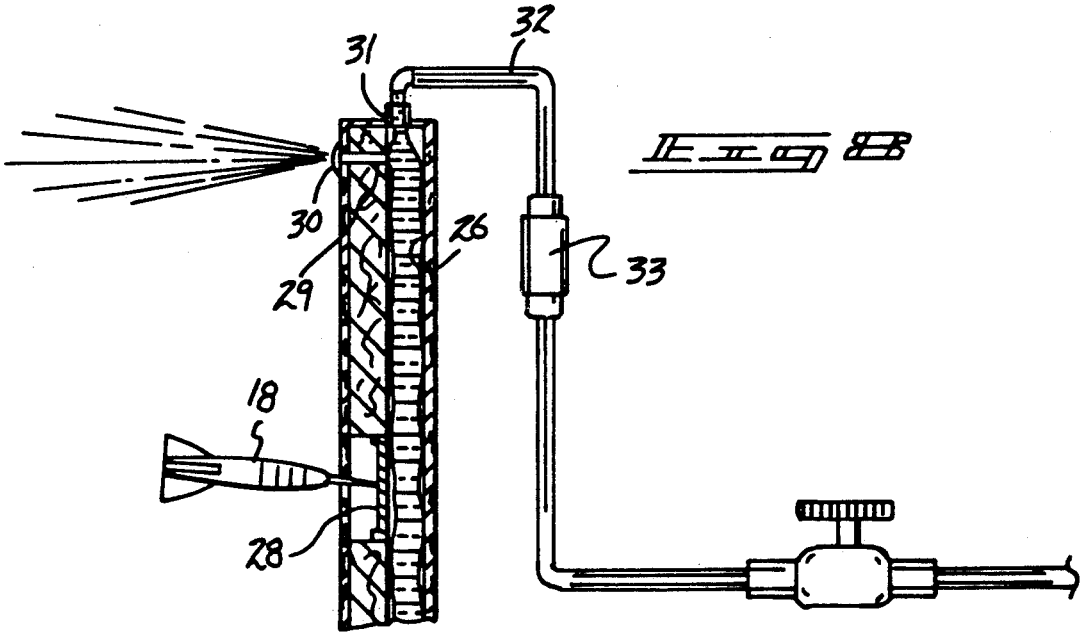
FIG. 8 is a modification of the water hazard bladder structure.

Similarly, the FIGS. 6-8 illustrate the use of the water hazard surface area 16, including an associated fluid bladder 26 positioned below the surface area 16, whereupon impacting of the fluid piston 28 slidably mounted within a second piston cavity 28*a* effects compression of the fluid bladder 26 to direct associated fluid 27 by compression of the fluid spring 27*a* through the fluid conduit 29 and the fluid exit port 30 directed through the top wall 12. A powder fill entrance cap 25 and a fluid fill entrance cap 31, as illustrated in the FIGS. 5 and 7 respectively, provide for selective filling of the associated powder chamber 19 and the bladder 26 respectively. If desired, a supply conduit 32 may be directed through the fluid fill conduit 31 in cooperation with a check valve 33 to effect application of a predetermined quantity of fluid within the bladder 26 at a desired pressure. As illustrated, upon impacting the bladder 26 or compression within the powder chamber 19, a spray of powder or fluid is effected for visual illustration of striking of a hazard and associated penalty strokes added to an individual's score.

Figure 9:
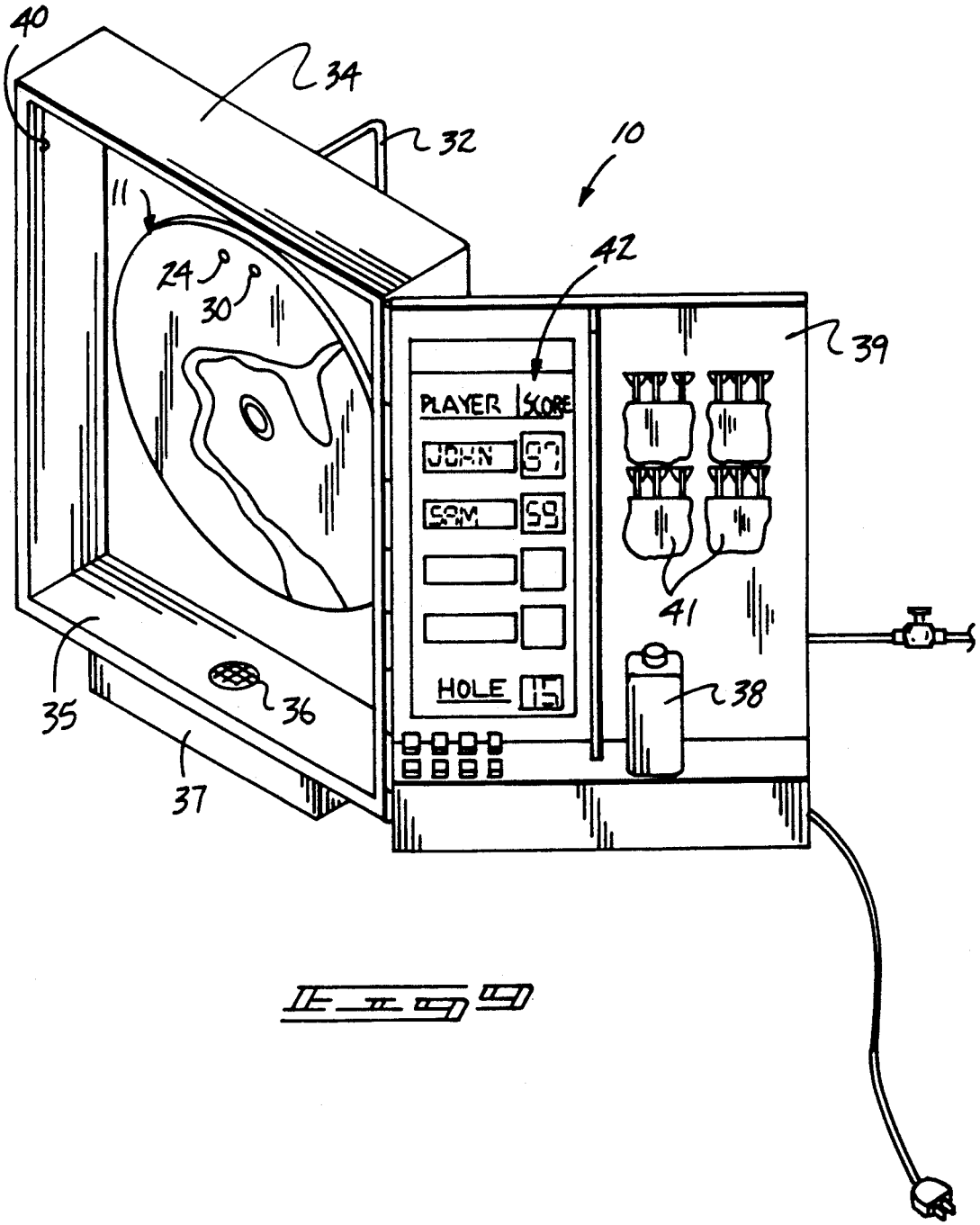
FIG. 9 is an isometric illustration of the invention in an encased configuration.

The FIG. 9 illustrates the use of a game housing 34, including a housing floor 35 including a drain 36 to direct fluid into an underlying fluid reservoir 37 contained below the floor 35. The housing further includes a powder refill container 38 mounted within a housing cover door 39. The housing cavity 40 defined within the housing 34 effects positioning of the game board 11 above the drain 36. Further, dart holder pockets 41 are mounted within an interior surface of the housing cover door 39, as well as a score keeping calculator 42 to providing a compact readily transported unit for use by individuals.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golfing dart game apparatus, comprising in combination, a game board, the game board including a top wall, the top wall including a polymeric covering coextensive with the top wall, and the game board including a plurality of target fairway surface areas, each fairway surface area of said fairway surface areas formed at the top wall includes a green, and the game board including a coaxially aligned central bull's-eye, and at least one water hazard surface area formed about the top wall and at least one of said target fairways including a sand trap area portion contiguous therewith, and a plurality of dart projectiles, and the game board includes a powder chamber exit port directed through the top wall, the powder chamber exit port in communication with the powder chamber exit conduit, and the powder chamber exit conduit in communication with a powder chamber formed within the game board below the top wall, and a piston cavity in communication between the powder chamber and the top wall, and a powder chamber piston slidably mounted within the piston cavity, and the powder chamber including a predetermined quantity of powder contained therewithin, whereupon impacting of the powder chamber piston effects compression of the powder contained within the powder chamber directing the powder through the powder chamber exit conduit and the powder chamber exit port, and the water hazard surface area includes a fluid bladder spaced from the powder chamber positioned below the top wall, and a second piston cavity in communication with the fluid bladder and the water hazard surface area positioned therebelow, with a fluid chamber piston slidably mounted within the second piston cavity, and the piston in contiguous communication with the fluid bladder, whereupon impacting of one of said dart projectiles with said fluid chamber piston effects compression of the bladder, and a fluid bladder conduit in fluid communication with the bladder and the top wall, with an exit port directed through the top wall in fluid communication with the fluid chamber conduit to direct fluid from the bladder through the fluid chamber conduit and the fluid chamber exit port.

2. An apparatus as set forth in claim 1 including a game housing, the game housing including a housing cavity, with the game board mounted within the housing cavity, and the housing cavity defined by a game housing floor positioned below the game board, with the floor including a floor drain directed therethrough, and a fluid reservoir positioned below the floor drain, and a housing cover door pivotally mounted to the game housing, with the cover door including a plurality of dart holder pockets containing the dart projectiles therewithin.

3. An apparatus as set forth in claim 2 wherein the fluid bladder includes a fluid fill supply conduit directed into the fluid bladder, and a check valve mounted within the fluid supply conduit to control pressurizing of the bladder.

* * * * *